United States Patent [19]

Ahn

[11] 4,372,828

[45] Feb. 8, 1983

[54] PROCESS FOR PREPARING ARSENIC ACID

[75] Inventor: Byung K. Ahn, Pittsburgh, Pa.

[73] Assignee: Koppers Company, Inc., Pittsburgh, Pa.

[21] Appl. No.: 347,919

[22] Filed: Feb. 11, 1982

[51] Int. Cl.[3] ..... C25B 1/22

[52] U.S. Cl. ..... 204/103

[58] Field of Search ..... 204/103

[56] References Cited

U.S. PATENT DOCUMENTS 4,021,321 5/1977 White ..... 204/103

*Primary Examiner*—R. L. Andrews

*Attorney, Agent, or Firm*—Donald M. MacKay; Herbert J. Zeh, Jr.; Oscar B. Brumback

[57] ABSTRACT

A pulsating potential is applied to the anode in the electrolytic oxidation of arsenic trioxide to arsenic acid to reactivate the anode and increase the current density.

9 Claims, No Drawings

PROCESS FOR PREPARING ARSENIC ACID

BRIEF DESCRIPTION OF THE INVENTION

Electrochemical synthesis of chemicals offers many advantages over conventional methods (e.g., in product purity, effluent control and process simplicity) but certain problems frequently offset these advantages. One problem common to several electrosynthetic processes is that of electrode deactivation or poisoning. A case in point occurs in the anodic oxidation of arsenic (III) oxide to arsenic (V) acid. Within seconds of applying a given potential to the anode (oxidation electrode), the current density typically drops to a few percent of its initial value. Similarly, under constant current conditions, the anode potential rises rapidly and most of the current is consumed by side reactions (mainly $O_2$ evolution).

It has now been discovered that a pulsating current can be employed wherein the anode operating potential is periodically reduced in an amount and for a time sufficient to reactivate the anode and increase the current density in the cell. In this manner the anode is reactivated so that the current density doesn't become or remain undesireably low and limit the output of the cell.

In a preferred embodiment, the electrolysis is conducted in an acid medium. While an alkaline medium such as NaOH, KOH, and $NH_4OH$ has the advantage that the alkali catalyzes air oxidation which occurs simultaneously with the anodic oxidation, the use of arsenic acid as the anolyte simplifies the product workup.

Conventional electrolytic cells and conditions can be employed. Typically, the electrolytic cell comprises an anode and cathode, each suspended in an anolyte and catholyte, respectively, and contained within compartments separated by a cell divider. Suitable dividers are materials having cation exchange properties such as dividers fabricated of fluorocarbon such as perfluorosulfonic acid resins or perfluorocarboxycylic acid resins which are available as hydraulically impermeable membranes. Typical cell dividers include polymeric materials having cation exchange properties. A particularly suitable membrane is a cation permselective membrane composed of a hydrolyzed copolymer of a perfluoroolefin and a fluorosulfonated ether, sold as "Nafion" perfluorosulfonic acid membranes by E. I. duPont de Nemours and Company.

Typical anolytes which can be employed include $NH_4OH$, $H_2SO_4$ and arsenic acid (3–10 M $H_3AsO_4$) solution of arsenious oxide. The latter is preferred because it doesn't introduce any unwanted impurities. Typical catholytes which can be employed include $NH_4OH$ and 2–5 M $H_2SO_4$ solution.

Typical electrodes which can be employed are those of platinum, ruthenium, rhodium, palladium, osmium, and iridium.

The initial current density without reactivation will depend upon the particular temperature, electrodes and electrolytes employed but generally will range between about 0.1 and about 0.2 $KA/m^2$. It has been found with the oxidation of arsenious acid in an acid medium that a rapid decay of current occurs, to 0.01–0.02 $KA/M^2$ in several minutes, at potentials known to be sufficient to oxidize As(III) e.g., 0.8 to 1.2 V vs. SCE (saturated calomel electrode). Surprisingly, however, the current density can be restored by briefly reducing the anode potential e.g., to 0.4 V vs. SCE or lower. A period at the operating potential of between about 1 and 11 seconds was found suitable with a time period at the lower reactivation potential of between 0.1 and 1.0 second. In this manner, the anode is reactivated and the high current density restored. The amount of reactivation mainly depends on the value of the reactivation potential (the lower, the more reactivated).

DETAILED DESCRIPTION OF THE INVENTION

The following examples will serve to illustrate preferred embodiments of the invention. All parts and percentages in said examples and elsewhere in the specification and claims are by weight unless otherwise specified.

EXAMPLES

An electrolysis cell was employed with an opposing anode and cathode separated by a divider membrane. A Pt foil of 4.2 $cm^2$ was used as the anode, a 45 mesh Pt gauze was used as the cathode and the divider membrane was formed of Nafion ® 425 (a perfluorosulfonic acid resin membrane manufactured by duPont). The initial anolyte was 20–30 g/l As (III) oxide in 2.9–3.8 M As (V) acid and the catholyte 2 M sulfuric acid. A potentiostatic pulse electrolysis was employed and evaluated in terms of reactivation potential, operating potential, temperature effect, and pulse duration.

Reactivation Potential: The reactivation potential was evaluated under electrolysis conditions in a potential range of 0.2–0.6 V versus SCE. The anodic potential had to be lowered to ≦0.4 V versus SCE in order to reactivate the anode. The low limit of 0.2 v was set to prevent possible side reactions such as hydrogen evolution and formation of elemental arsenic at the anode during reactivation. As shown in the following Table 1, the optimum reactivation potential for maximum current density was 0.2 V versus SCE at the following other fixed conditions.

TABLE 1

Evaluations of Reactivation Potential for Potentiostatic Pulse Electrolysis temperature, 50° C.
anolyte; 20.4–21.5 g/l $As_2O_3$ in 3.3M $H_3AsO_4$
catholyte; 1.92–1.99M $H_2SO_4$
pulse condition; 11 seconds at 1.0V versus SCE and 1 second at reactivation potential

| Reactivation Potential (V versus SCE) | Maximum Anodic Current (A)* | Maximum Cathodic Current (A)** | Average Current (A)*** |
|---|---|---|---|
| 0.2 | 0.510–0.625 | 0.070 | 0.047 |
| 0.3 | 0.445–0.475 | 0.049 | 0.034 |
| 0.4 | 0.305–0.316 | 0.030 | 0.024 |
| 0.5 | 0.155–0.075 | 0.008 | 0.008 |
| 0.6 | 0.045–0.006 | 0.000 | 0.003 |

*The initial current output at the operating potential after reactivation.
**The initial current output at the reactivation potential after deactivation at the operating potential.
***The average current based on anodic charge minus cathodic charge.

Operating Potential: The anodic operating potential was set at a range of 1.0–1.2 V versus SCE at 50° C. The pulse regime employed times of 11 seconds at the operating potential and 1 second at the reactivation potential (0.2 V versus SCE). The desire was for maximum current density combined with maximum current efficiency. As shown in the following Table 2, the current efficiency was ca. 100% at operating potentials of ≦1.1 V, but dropped to 77% at 1.2 V.

TABLE 2

Evaluations of Operating Potential for Potentiostatic Pulse Electrolysis temperature; 50° C.

anolyte; from 24 to 18-21 g/l $As_2O_3$ in 3-3.5M $H_3AsO_4$ catholyte; 1.9-2.1M $H_2SO_4$

| Operating Potential (V versus SCE) | Average Current Density (KA/sq.M)* | Current Efficiency** (%) |
|---|---|---|
| 1.0 | 0.071 | 103*** |
| 1.1 | 0.059 | 105*** |
| 1.2 | 0.092 | 77 |

*Based on anodic charge and surface area of both sides (8.4 $cm^2$)

**Based on total anodic charge and loss of As(III) oxide from anolyte.

***Due to the diffusional loss of As(III) oxide to catholyte, accounting for ≦5% current efficiency.

Temperature Effect: The temperature effect was evaluated over the range 50°-70° C. Pulses were 1.0 V for 11 seconds and 0.2 V for 1 second. At 70° C., the current efficiency and the average anodic current density were 96% and 0.143 KA/sq.M, resp. with an initial concentration of 17 g/l As(III) oxide and a final concentration of 12 g/l As(III) oxide in 3.76-4.02 M As(V) acid as anolyte. At 50° C., they were 100% and 0.071 KA/sq. M with an initial concentration of 24 g/l As(III) oxide and a final concentration of 18 g/l As(III) oxide in 3.34-3.36 M As(V) acid. The current density was doubled as temperature was raised from 50° to 70° C.

Pulse Duration: Pulses of 1.0 V/0.2 V versus SCE were employed at different operating to reactivation time ratios in anolytes containing initially 19-31 g/l As(III) oxide in 2.9-3.4 M As(V) acid and finally 8-18 g/l As(III) oxide in 3.2-3.5 M As(V) acid at 50° C. The results are shown in the following Table 3.

TABLE 3

Operating/Reactivation Time Durations for Pulse Versus Cell Performance in Potentiostatic Pulse Electrolysis temperature; 50° C.
anolyte; from 19-13 to 8-18 g/l $As_2O_3$ in 2.9-3.5M $H_3AsO_4$
catholyte; 1.9-2.1M $H_2SO_4$
operating potential; 1.0V versus SCE
reactivation potential; 0.2V versus SCE

| Operating/ Reactivation Duration (second) | Current Efficiency (%)* | Anodic Current Density (KA/sq.M)** Maximum | Minimum | Average |
|---|---|---|---|---|
| 11.0/1.0 | 103 | 0.56-0.65 | 0.01-0.02 | 0.07 |
| 3.0/0.5 | 103 | 0.61-0.70 | 0.02-0.06 | 0.16 |
| 2.2/0.2 | 102 | 0.63-0.51 | 0.07-0.09 | 0.22 |
| 1.1/0.1 | 97 | 0.48-0.38 | 0.12-0.15 | 0.27 |
| 1.0/0.2 | 104 | 0.65-0.38 | 0.21-0.11 | 0.24 |
| 1.1/0.5 | 102 | 0.62-0.29 | 0.29-0.11 | 0.26 |

*Based on anodic charge and loss of As(III) oxide from anolyte. The diffusional loss to catholyte accounts for ≦5% current efficiency.
**Based on surface area of both side (8.4 $cm^2$). The maximum is right after reactivation and the minimum is after deactivation at operating potential throughout operating duration.

While the above is illustrative of the invention, numerous obvious variations and modification may be apparent to one of ordinary skill in the art and accordingly the invention is intended to be limited only by the appended claims.

What is claimed is:

1. A process for the oxidation of $As_2O_3$ to $H_3AsO_4$ in an electrolysis cell which comprises, periodically reducing the anode operating potential, in an amount and for a time sufficient to reactivate the anode so as to increase the current density in the cell.

2. The process of claim 1 wherein the anode operating potential is within a set range of about 1.0-1.1 V versus SCE and is periodically reduced to a lower level reactivation potential within a range of about 0.2-0.4 V versus SCE.

3. The process of claim 2 wherein the operating potential duration is ≦3 seconds and the reactivation potential is ≦0.5 seconds.

4. The process of claim 2 wherein the operating potential is maintained for between about 1 and about 11 seconds and alternated with a reactivation potential maintained for between about 0.1 and about 1.0 second.

5. The process of claim 1 wherein the anode is formed of Pt.

6. The process of claim 1 wherein the electrodes are separated by a divider formed of a material having cation exchange properties.

7. The process of claim 1 wherein the cell is operated at a temperature between about 50° and about 70° C.

8. The process of claim 1 wherein the cathode is formed of Pt.

9. The process of claim 1 wherein the anolyte comprises arsenic acid containing arsenious oxide.

* * * * *